US010506335B2

(12) United States Patent
Kagawa et al.

(10) Patent No.: US 10,506,335 B2
(45) Date of Patent: Dec. 10, 2019

(54) ELECTROACOUSTIC TRANSDUCER

(71) Applicant: Panasonic Intellectual Property Management Co., Ltd., Osaka (JP)

(72) Inventors: Shinya Kagawa, Osaka (JP); Mitsukazu Kuze, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/000,867

(22) Filed: Jun. 5, 2018

(65) Prior Publication Data

US 2018/0288524 A1 Oct. 4, 2018

Related U.S. Application Data

(63) Continuation of application No. PCT/JP2016/005102, filed on Dec. 12, 2016.

(30) Foreign Application Priority Data

Dec. 17, 2015 (JP) ..... 2015-246701

(51) Int. Cl.
*H04R 1/28* (2006.01)
*H04R 7/04* (2006.01)
*H04R 9/04* (2006.01)

(52) U.S. Cl.
CPC ..... *H04R 1/2892* (2013.01); *H04R 7/04* (2013.01); *H04R 9/04* (2013.01)

(58) Field of Classification Search
CPC ..... H04R 1/28; H04R 1/02; H04R 1/2892; H04R 7/04; H04R 9/02; H04R 9/04; H04R 7/20; H04R 2499/13
USPC ..... 381/388, 423, 401, 412, 182; 181/187
See application file for complete search history.

(56) References Cited

U.S. PATENT DOCUMENTS 8,213,671 B2 * 7/2012 Matsuda ..... H04R 9/06 181/157

FOREIGN PATENT DOCUMENTS

| | | | | |
|---|---|---|---|---|
| JP | 56-056095 | | 5/1981 | |
| JP | 60-177798 | | 9/1985 | |
| JP | 60177798 A | * | 9/1985 | ..... H04R 1/24 |
| JP | 06056095 A | * | 3/1994 | ..... B64C 13/02 |
| JP | 6-178388 | | 6/1994 | |
| JP | 06178388 A | * | 6/1994 | |

OTHER PUBLICATIONS

International Search Report of PCT application No. PCT/JP2016/005102 dated Feb. 21, 2017.

* cited by examiner

*Primary Examiner* — Melur Ramakrishnaiah
(74) *Attorney, Agent, or Firm* — Greenblum & Bernstein, P.L.C.

(57) ABSTRACT

An electroacoustic transducer includes a diaphragm, a frame disposed to surround a rim portion of the diaphragm, a front support body and a rear support body that couple the diaphragm and the frame, and a magnetic circuit provided with an annular magnetic gap facing a rear face of the diaphragm. The electroacoustic transducer further includes a voice coil body having a rear end disposed in the magnetic gap and a front end coupled to the diaphragm.

4 Claims, 8 Drawing Sheets

ELECTROACOUSTIC TRANSDUCER

CROSS-REFERENCE TO RELATED APPLICATIONS

This application is a continuation of the PCT International Application No. PCT/JP2016/005102 filed on Dec. 12, 2016, which claims the benefit of foreign priority of Japanese patent application No. 2015-246701 filed on Dec. 17, 2015, the contents all of which are incorporated herein by reference.

BACKGROUND

1. Technical Field

The present disclosure relates to an electroacoustic transducer, such as a loudspeaker and a microphone, that converts an electric signal into sound, or sound into an electric signal.

2. Description of the Related Art

In recent years, digital-signal processing technology has been developed dramatically, and quality of electric signals, which represent sound, is improved drastically. The above-mentioned development requires an electroacoustic transducer, such as a loudspeaker capable of reproducing high-quality sound, and a microphone capable of converting sound into an electric signal accurately without distortion.

On the other hand, slim down of an electroacoustic transducer is also desired. For instance, to achieve the slim down of an electroacoustic transducer, a diaphragm, which is vibrated to generate sound or vibrates according to vibration of sound, is formed into a plate-like shape, as described in Unexamined Japanese Patent Publication No. S56-56095.

SUMMARY

The disclosure aims to provide an electroacoustic transducer capable of drastically reducing occurrence of distortion, such as harmonics distortion.

The electroacoustic transducer in accordance with the present disclosure, which converts an electric signal and sound mutually therebetween, includes a diaphragm, a frame, a front support body, a rear support body, a magnetic circuit, and a voice coil body. The diaphragm includes a central portion and a rim portion thicker than the central portion. The diaphragm has a front face toward a front and a rear face toward a rear. The frame is disposed to surround the rim portion of the diaphragm and has a front annular portion corresponding to a front part of the rim portion and a rear annular portion corresponding to a rear part of the rim portion. The front support body couples the front part of the rim portion and the front annular portion of the frame, and has a plurality of front projections projecting toward the front and a plurality of front depressions depressing toward the rear. The rear support body couples the rear part of the rim portion and the rear annular portion of the frame, and has a plurality of rear projections projecting toward the front and a plurality of rear depressions depressing toward the rear. The magnetic circuit is provided with an annular magnetic gap facing the rear face of the diaphragm and is fixed to the frame. The voice coil body has a rear end disposed in the magnetic gap and a front end connected to the diaphragm.

The present disclosure makes it possible to achieve an electroacoustic transducer capable of drastically reducing occurrence of distortion.

DETAILED DESCRIPTION OF PREFERRED EMBODIMENTS

Figure 1:
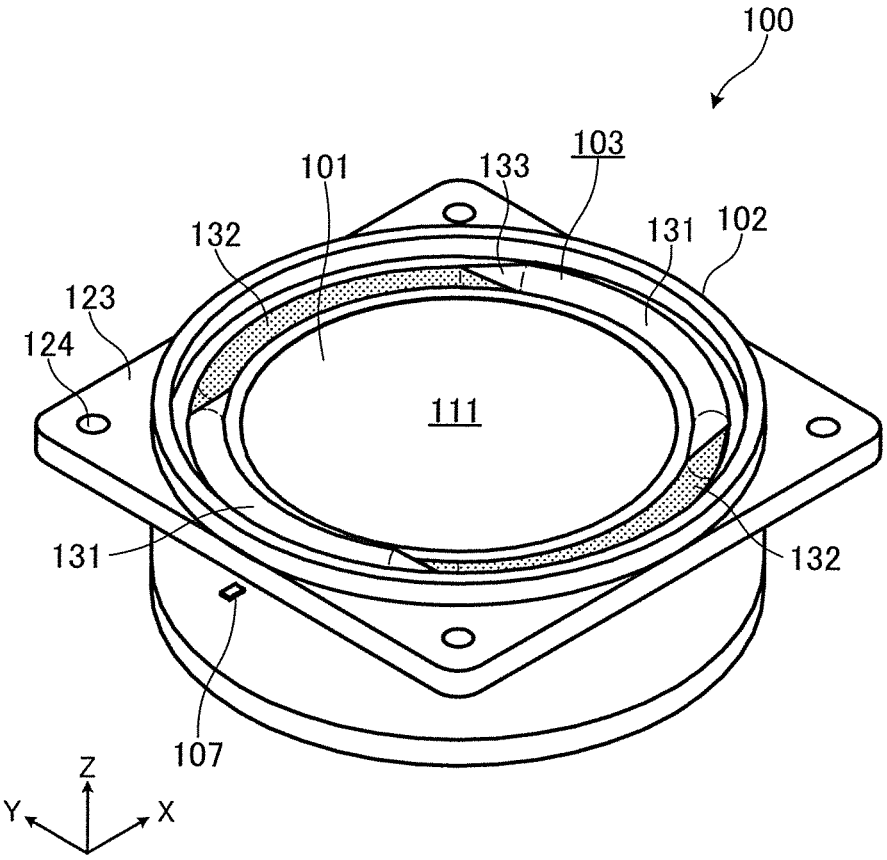
FIG. 1 is a perspective view of a loudspeaker in the present exemplary embodiment.

Prior to description of the embodiment of the present disclosure, problems in the conventional electroacoustic transducers is briefly described. In the conventional electroacoustic transducer having a support body that supports a diaphragm with respect to a frame, the support body may cause harmonics distortion or the like in a low-pitched sound region in which amplitude of the diaphragm is enhanced. In other words, when the diaphragm vibrates with large amplitude, the support body may be strained due to inability to follow the vibration of the diaphragm. This causes high frequency distortion, disadvantageously.

Further, a diaphragm vibrates frontward and rearward from a neutral point, and a support body that supports the diaphragm also vibrates according to the diaphragm. However, an amount of air removed by the support body is different between when the diaphragm moves frontward from a position of the neutral point and when the diaphragm moves rearward from the position of the neutral point. In a case where the amount of air to be removed is different between when the diaphragm moves outwardly and when moves inwardly, the sound pressure characteristic of the electroacoustic transducer will contain a distortion component.

Next, an exemplary embodiment of the electroacoustic transducer in accordance with the present disclosure will be described with reference to the drawings. Note that, the following exemplary embodiment merely shows an example of the electroacoustic transducer in accordance with the present disclosure. Accordingly, a scope of claims should be interpreted literally with reference to the following exemplary embodiments, but the present disclosure is not limited to only the following exemplary embodiment. Therefore, among elements in the following embodiments, those not recited in any of the independent claims defining the most generic concept of the present disclosure, if not necessary to achieve the object of the present disclosure, are described as elements for configuring a more preferable aspect.

Further, the drawing is a schematic view that is highlighted, omitted, or adjusted in ratio, as necessary, to illustrate the present disclosure, but may differ in actual shape, physical relationship, and ratio.

In the case of the present exemplary embodiment, loudspeaker 100 serving as one of electroacoustic transducers will be described as an example. For loudspeaker 100, various kinds of configurations are required according to its use. In the case of the present exemplary embodiment, there will be described thin loudspeaker 100 to be installed in narrow spaces such as a dashboard of an automobile, a door of an automobile, and a ceiling of an automobile, for example.

FIG. 1 is a perspective view of a loudspeaker in the present exemplary embodiment. Note that, the depressed portion shown in the view is denoted by dark color.

Figure 2:
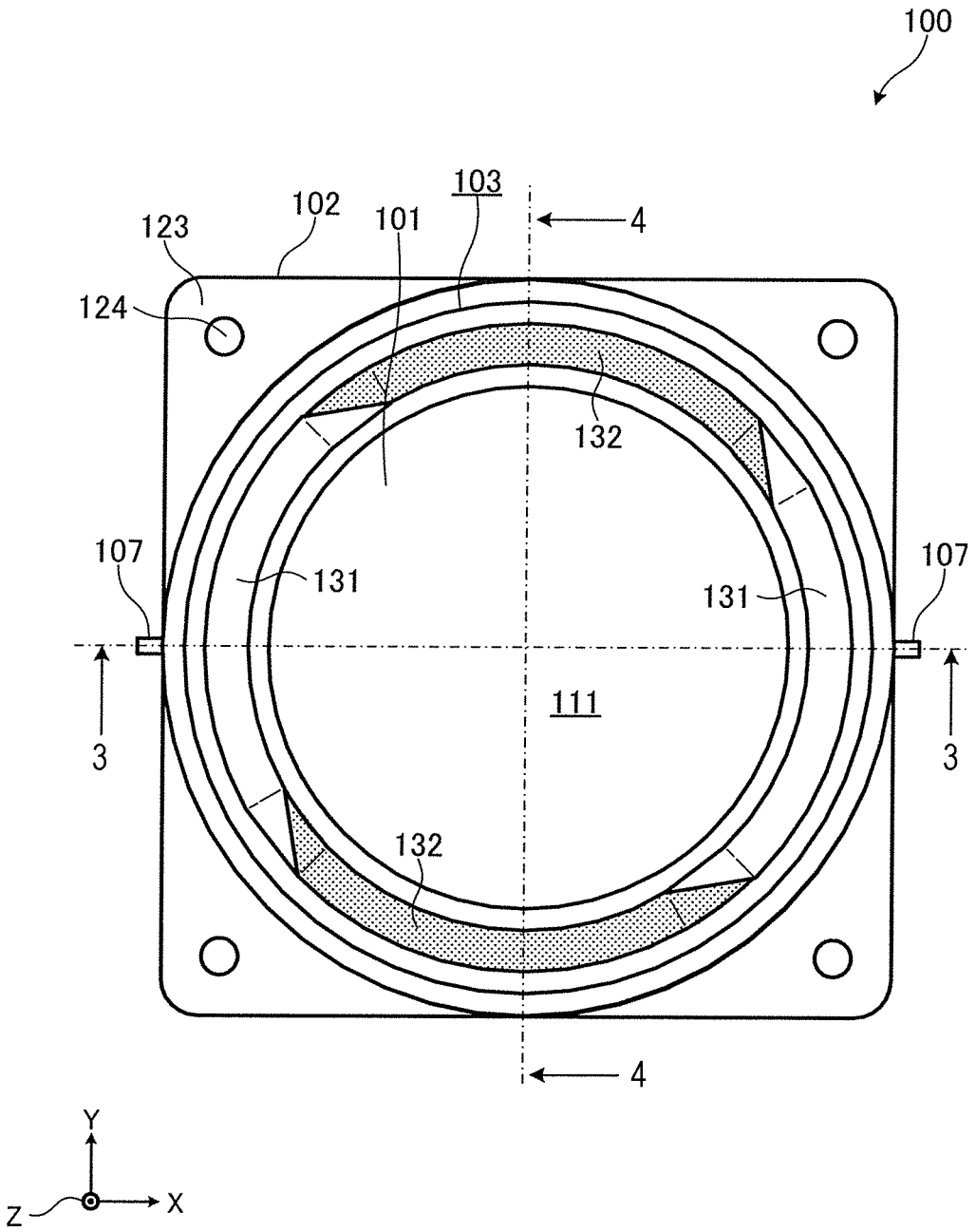
FIG. 2 is a front view of the loudspeaker in the present exemplary embodiment.

FIG. 2 is a front view of the loudspeaker in the present exemplary embodiment.

Figure 3:
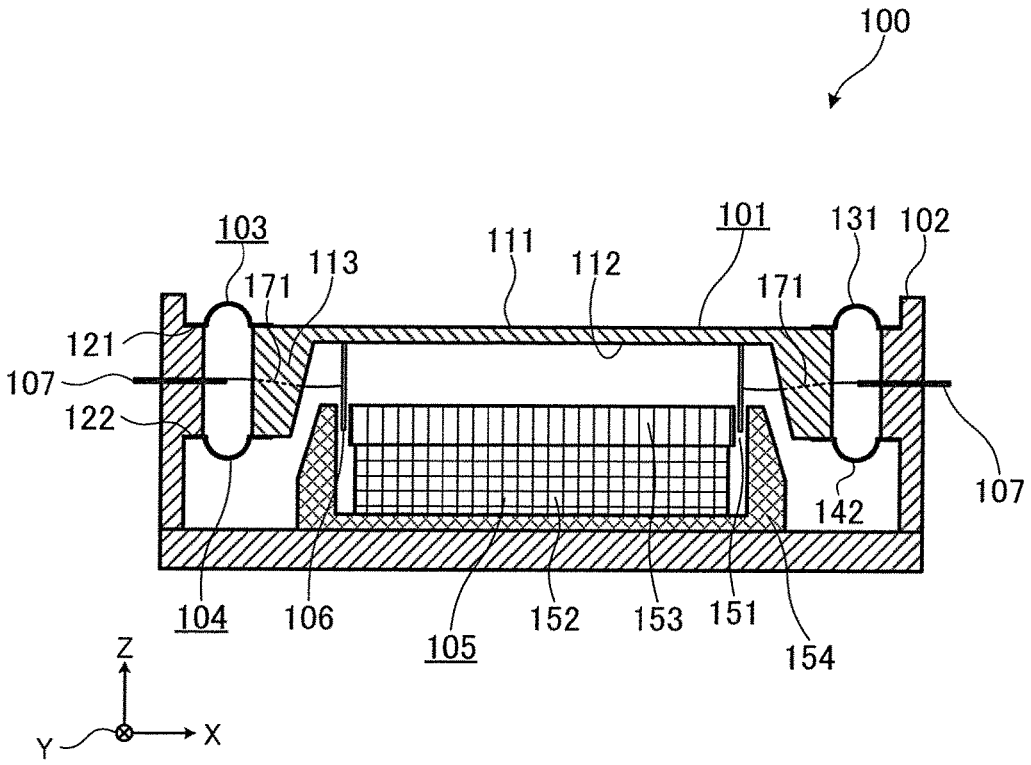
FIG. 3 is a cross-sectional view of the loudspeaker taken along line 3-3 in FIG. 2.

FIG. 3 is a cross-sectional view of the loudspeaker taken along line 3-3 in FIG. 2.

Figure 4:
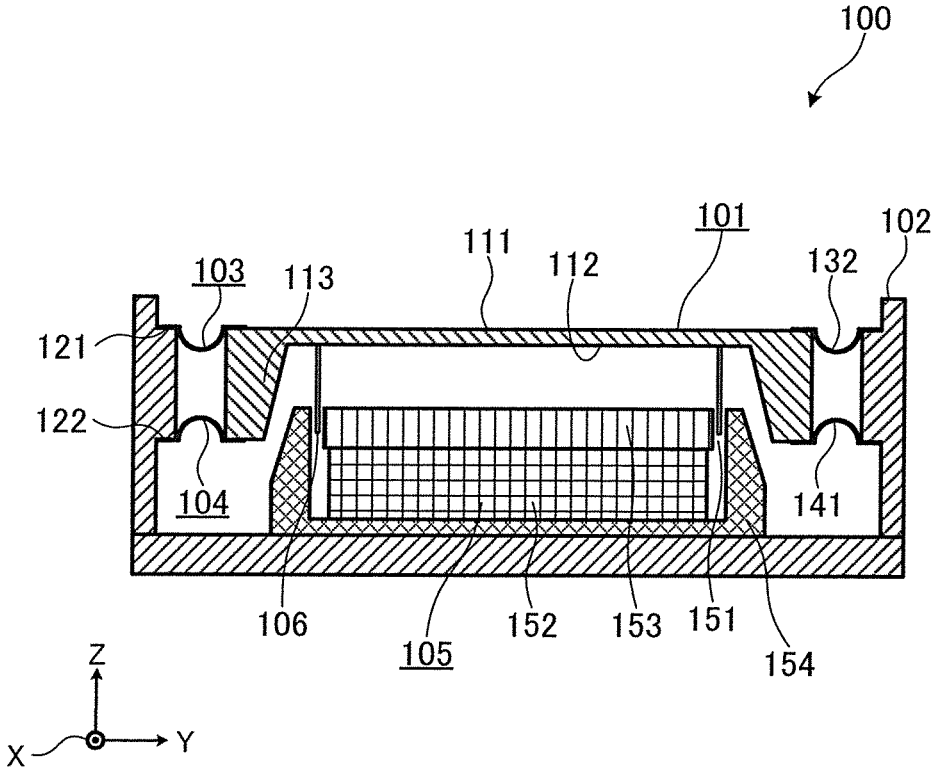
FIG. 4 is a cross-sectional view of the loudspeaker taken along line 4-4 in FIG. 2.

FIG. 4 is a cross-sectional view of the loudspeaker taken along line 4-4 in FIG. 2.

As shown in these drawings, loudspeaker 100 is an electroacoustic transducer for converting an electric signal into sound, and includes diaphragm 101, frame 102, front support body 103, rear support body 104, magnetic circuit 105, and voice coil body 106.

Diaphragm 101 is a member that is displaced, based on an electric signal, in a forward/rearward direction (a direction of Z-axis in the view, i.e., a thickness direction of diaphragm 101) with respect to a neutral position, thereby vibrating the air to generate sound. Diaphragm 101 has front face 111 toward a front (a positive side of Z-axis in the drawings) and disposed along X-Y plane, and rear face 112 toward a rear and disposed along X-Y plane. In a rim portion of diaphragm 101, thick portion 113 thicker than a central portion is provided. Diaphragm 101 is disposed in the center of a hollow portion of frame 102.

In the case of the present exemplary embodiment, diaphragm 101 is formed into a plate-like shape, and is thinner than a corn-typed diaphragm. This makes it possible to slim down the entirety of loudspeaker 100.

A material for constituting diaphragm 101 is not limited in particular, but diaphragm 101 may include a core made of foaming resin, for example. With this configuration, diaphragm 101 can be light in weight, thereby making it possible to improve response characteristic of diaphragm 101. Furthermore, a reinforcement layer made of aluminum, titanium, carbon, or the like may be provided on the core.

Further, a diaphragm of a honeycomb flat-plate type may be employed, i.e., a honeycomb core may be provided therein and skin layers may be provided on up and down sides of the honeycomb core. In this case, when aluminum or paper is employed as the honeycomb core or the up-and-down skin layers, the diaphragm can be lighter in weight, thereby making it possible to further improve the response characteristic.

Thick portion 113 is an annular portion to which front support body 103 and rear support body 104 are attached, and increases structural strength of diaphragm 101. In the case of the present exemplary embodiment, thick portion 113 is integrally formed with diaphragm 101. As separate structure, however, thick portion 113 may be attached to a plate-like diaphragm through adhesion or the like.

Frame 102 is a member serving as a fundamental structure of loudspeaker 100, and is a cylindrical case having a hollow portion therein. Frame 102 is disposed to surround the rim portion of diaphragm 101. As shown in FIGS. 3 and 4, frame 102 includes front annular portion 121 and rear annular portion 122. Front annular portion 121 is disposed to face a front part of thick portion 113 provided in the rim portion of diaphragm 101, and rear annular portion 122 is disposed to face a rear part of thick portion 113. In the case of the present exemplary embodiment, front annular portion 121 and rear annular portion 122 respectively correspond to a front face and a rear face of an annular flange that is projected inwardly from an inner circumferential surface of frame 102.

In the case of the present exemplary embodiment, frame 102 has attachment part 123, as shown in FIGS. 1 and 2. Since frame 102 has attachment part 123, loudspeaker 100 can easily be attached to a baffle board (not shown) or the like through attachment part 123. Further, screw hole 124 may be formed in attachment part 123. In this case, loudspeaker 100 can easily be screwed to a baffle board or the like through screw hole 124 and fixed. Note that, frame 102 does not need to have attachment part 123. Further, frame 102 is preferably molded of a synthetic resin material.

Figure 5:
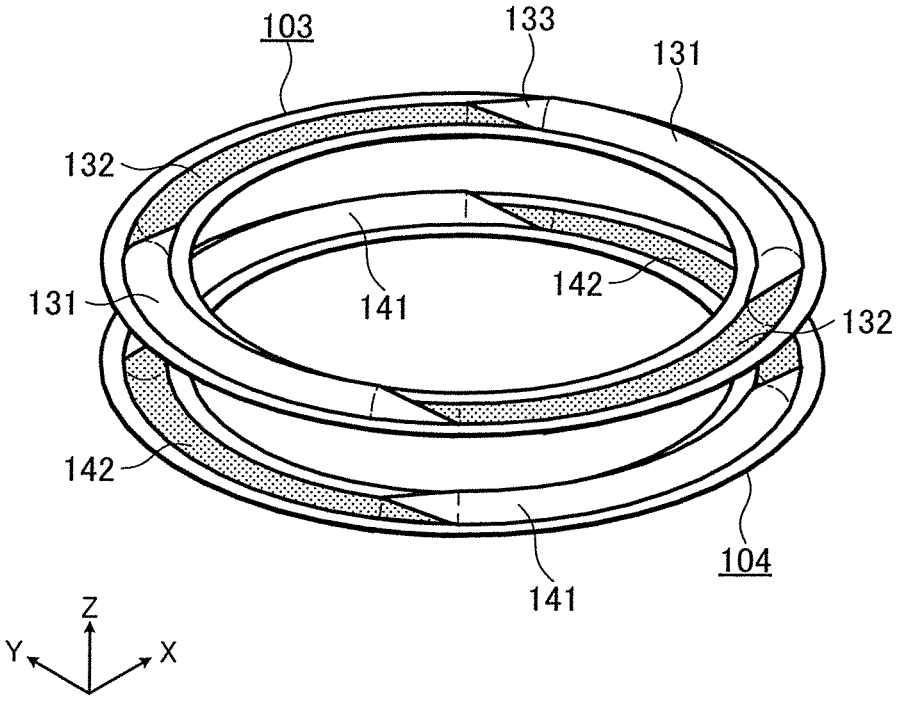
FIG. 5 is a perspective view showing a front support body and a rear support body.

FIG. 5 is a perspective view showing the front support body and the rear support body.

Front support body 103 is a flexible and resilient member for connecting the front part of thick portion 113 and front annular portion 121 of frame 102. Rear support body 104 is a flexible and resilient member for connecting the rear part of thick portion 113 and rear annular portion 122 of frame 102. Front support body 103 and rear support body 104 are annular members arranged apart from each other by an interval (or a distance) corresponding to a thickness of thick portion 113. Front support body 103 and rear support body 104 are also members for positioning diaphragm 101 in the center of frame 102. When no electric signal is supplied, diaphragm 101 is positioned in the neutral position.

Further, front support body 103 includes a plurality of front projections 131 (two in the case of the present exemplary embodiment) and a plurality of front depressions 132 (two in the case of the present exemplary embodiment). Front projections 131 projects toward the front (a positive side of Z-axis in the view) and front depressions 132 depresses toward the rear (a negative side of Z-axis in the view). Rear support body 104 includes a plurality of rear projections 141 (two in the case of the present exemplary embodiment) and a plurality of rear depressions 142 (two in the case of the present exemplary embodiment). Rear projections 141 projects toward the front and rear depressions 142 depressed toward the rear. Since front support body 103 and rear support body 104 each include projections and depressions, vibration of diaphragm 101 can be equalized between the front and the rear. Furthermore, a removal amount of the air can also be equalized between the front and the rear, thereby making it possible to reduce distortion.

Further, each of front support body 103 and rear support body 104 includes an annular inner attachment part with a rectangular cross-section that is attached to thick portion 113 of diaphragm 101, and an annular outer attachment part with a rectangular cross-section that is attached to frame 102.

A cross-sectional shape of front projection 131 taken along the radial direction, and a cross-sectional shape of front depression 132 taken along the radial direction are symmetrical in the forward/rearward direction (the direction of Z-axis in the drawing). Further, in the plan view (in the view shown in FIG. 2), an area occupied by front projections 131 and an area occupied by front depressions 132 are the same, i.e., a total length of front projections 131 in the circumferential direction of front support body 103 and a total length of front depressions 132, both in the circumferential direction of front support body 103, are the same. In other words, the volume of front projections 131 and the volume of front depressions 132 are the same.

Further, front projection 131 and front depression 132 are connected through front connection part 133 of which cross-sections therebetween taken along the radial direction are gradually and continuously different.

Figure 7A:
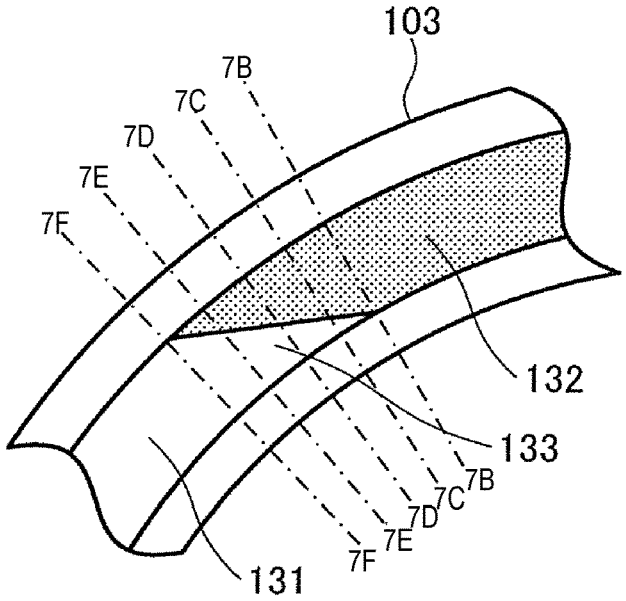
FIG. 7A is an enlarged plan view of a front connecting part.
Figure 7B:
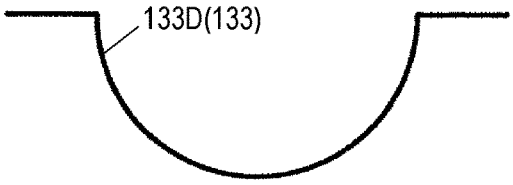
FIGS. 7B to 7F are views showing cross-sectional shapes of the front connecting part in a radial direction.
Figure 7C:
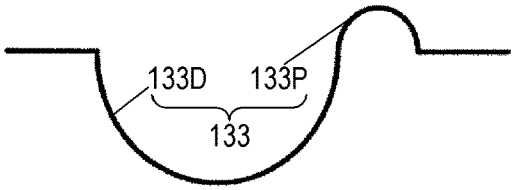
Figure 7D:
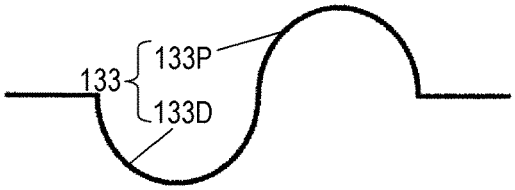
Figure 7E:
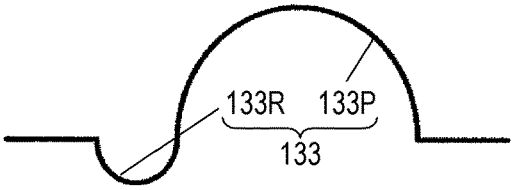
Figure 7F:
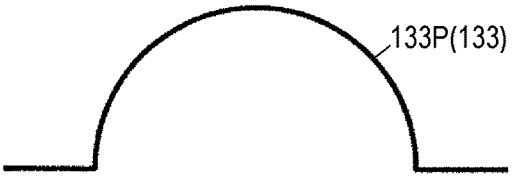

FIG. 7A is an enlarged plan view of a front connecting part, and FIGS. 7B to 7F are views showing cross-sectional shapes of the front connecting part in a radial direction at different positions.

As shown in the drawings, each of the cross-sections of front connection part 133 taken along the radial direction are constituted by two shapes, i.e., convex shape 133P and concave shape 133D. Concave shape 133P of front connection part 133 becomes gradually smaller as it approaches front projection 131 from front depression 132. On the other hand, convex shape 133D of front connection part 133 becomes gradually larger as it approaches front projection 131 from front depression 132. Further, the length of the cross-sectional shapes of front connection part 133 taken along the radial direction is constant.

The above-mentioned relationship between front projection 131 and front depression 132 allows the sum of an amount of air removed by front projection 131 of front support body 103 and an amount of air removed by front depression 132 according to vibration amplitude of diaphragm 101 equal between a case where diaphragm 101 is moved frontward and a case where diaphragm 101 is moved rearward from the neutral point at which diaphragm 101 is located when no electric signal is applied. This makes it possible to prevent occurrence of air distortion. Further, asymmetry of the force that supports diaphragm 101, which is caused by structural asymmetry, can also be reduced, thereby making it possible to prevent occurrence of amplitude distortion of sound.

Still further, a relationship between rear projection 141 and rear depression 142 of rear support body 104 are the same as the above-mentioned relationship, thereby achieving the same operation effect.

Note that, the cross-sectional shape of the convex part or the concave part may not be limited in particular, but an arc, an elliptical arc, a parabolic shape, or the like may be employed.

Furthermore, front support body 103 and rear support body 104 are disposed such that front projection 131 and rear depression 142 face each other as shown in FIGS. 3 and 5, and front depression 132 and rear projection 141 face each other as shown in FIGS. 4 and 5. In the case of the present exemplary embodiment, front support body 103 and rear support body 104 are disposed plane symmetrically with respect to X-Y plane as a symmetry plane. In other words, diaphragm 101 is supported by two support bodies that are plane symmetrical to each other in the forward/rearward direction structurally. This makes it possible to obtain symmetrical stiffness in the forward/rearward direction, so that the occurrence of distortion can be prevented drastically. Further, rolling of diaphragm 101 caused by structural asymmetry can be prevented.

Further, as shown in FIG. 3, a large space can be secured between front support body 103 and rear support body 104. This makes it possible to wire lead 171 in the above-mentioned space. Herein, lead 171 is wiring for connecting electrode terminal 107 and voice coil body 106. Accordingly, slim down of loudspeaker 100 can be achieved. Still further, sufficient length of lead 171 can be secured, so that lead 171 is allowed to follow the vibration of diaphragm 101. This makes it possible to avoid disconnection caused by the tension on lead 171 when vibrations with large amplitude are applied.

Furthermore, two pairs of front projection 131 and rear depression 142, which face each other, are disposed to have 180-degree rotational symmetry. Two electrode terminals 107 are formed through frame 102 from the inside toward the outside of frame 102, and are connected to voice coil body 106. Each of two electrode terminals 107 is disposed between one of the two pairs of front projection 131 and rear depression 142. As described above, the two pairs are located to satisfy 180-degree relationship. Thus, the force received by voice coil body 106 from lead 171 can be made equal. This makes it possible to prevent rolling and suppress occurrence of distortion of sound.

Further, thick portion 113 of diaphragm 101, and front annular portion 121 and rear annular portion 122 of frame 102 corresponding to thick portion 113 can secure a sufficient interval between front support body 103 and rear support body 104. Thus, irrespective of the thickness of diaphragm 101, front depression 132 of front support body 103 and rear projection 141 of rear support body 104, which face each other, are prevented from colliding. Therefore, occurrence of impact noise caused by front support body 103 and rear support body 104 can be prevented, thereby making it possible to achieve distortion-less and good quality sound.

Note that, a material for constituting front support body 103 and rear support body 104 is not limited in particular, but a flexible and resilient material such as elastomer and foamed rubber may be employed, for example.

Figure 6:
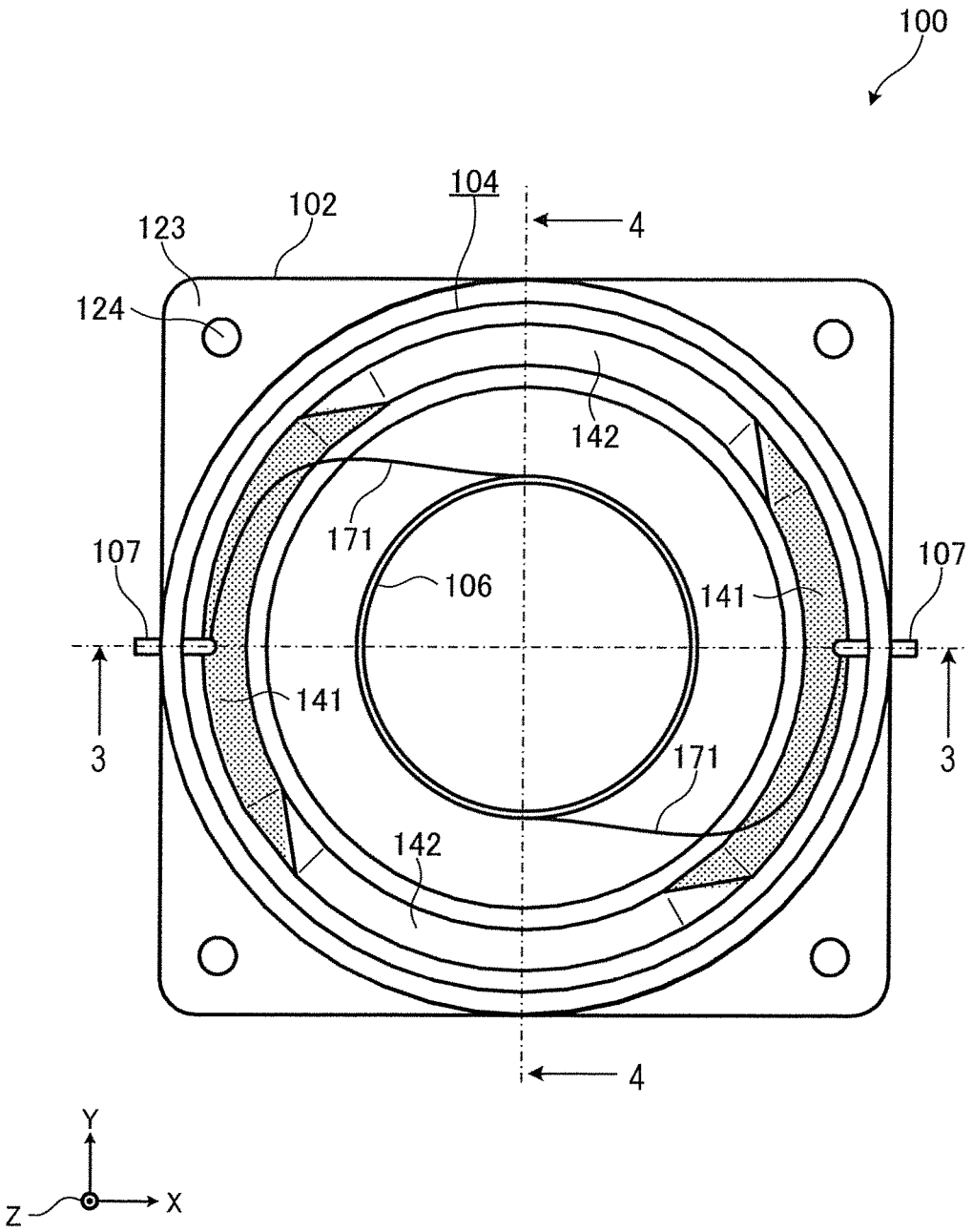
FIG. 6 is a plan view showing a forming state of leads.

Next, a wiring forming method, which can secure a sufficient length of lead 171, will be described. FIG. 6 is a plan view showing a forming state of lead 171, in which diaphragm 101, front support 103, and the like are omitted. As shown in FIG. 6, to achieve a weight balance at the time when loudspeaker 100 vibrates, one of two leads 171 is drawn out from voice coil body 106 at a position where is shifted 180-degree from a position where the other of two leads 171 is drawn out from voice coil body 106.

After that, leads 171 are drawn out in directions opposite to each other and inserted through thick portion 113 of diaphragm 101, and then drawn out to a large space formed between front support body 103 and rear support body 104.

Herein, the space to which leads 171 are drawn out is the large space that front projection 131 and rear depression 142 forms by facing each other. Subsequently, leads 171 are formed along a shape of the large space, while securing a sufficient length, extend toward electrode terminals 107, respectively, which are disposed in directions opposite to each other, and then are connected to electrode terminals 107, respectively.

As mentioned above, each of leads 171 is formed to have an arc shape along the shape of the large space formed between front support body 103 and rear support body 104, while securing a sufficient margin in shape and length. Thus, even if loudspeaker 100 is subjected to large vibrations, leads 171 will not be extended to be straight, thereby making it possible to prevent the disconnection.

As lead 171, a gold thread line is used. Such a line is usually employed for a loudspeaker; however, lead 171 is not limited to this. Instead of the gold thread line, a magnet wire, which is employed as a coil, may be used as lead 171 after drawn out from voice coil body 106 directly.

Magnetic circuit 105 displaces voice coil body 106 frontward and rearward by acting on a magnetic flux generated in voice coil body 106 based on an electric signal. As shown in FIGS. 3 and 4, magnetic circuit 105 is provided with annular magnetic gap 151 facing rear face 112 of diaphragm 101 and is fixed to frame 102. In the case of the present exemplary embodiment, magnetic circuit 105 is of an inner magnet type. Magnetic circuit 105 is constituted by cylindrical magnet 152 magnetized in the frontward/rearward direction, disk-shaped top plate 153 disposed on an upper surface of magnet 152, and closed cylindrical yoke 154 disposed to surround top plate 153. Top plate 153 and yoke 154 are made of a magnetic material. For instance, a neodymium based magnet, which has high magnetic flux density, may preferably be used as magnet 152. Thus, magnet 152 can be thin, thereby the entirety of loudspeaker 100 can also be thin.

An inner circumferential surface of yoke 154 faces an outer circumferential surface of top plate 153 at a predetermined interval therebetween. Thus, magnetic gap 151 is formed between the inner circumferential surface of yoke 154 and the outer circumferential surface of top plate 153. Further, to avoid interference (contact) with thick portion 113 at the time when diaphragm 101 vibrates, an outer circumferential surface of yoke 154 is tapered.

Voice coil body 106 has a rear end disposed in magnetic gap 151 of magnetic circuit 105 and a front end coupled to diaphragm 101. Voice coil body 106 can generate a magnetic flux based on an electric signal to be inputted, and interact with magnetic circuit 105 to be vibrated frontward and rearward.

A winding axis (central axis) of voice coil body 106 is aligned with a direction (the direction of Z-axis in the view) of vibration of diaphragm 101 and intersects perpendicularly with a direction of the magnetic flux within magnetic gap 151.

In the case of the present exemplary embodiment, voice coil body 106 includes a bobbin, and a coil wound around the bobbin. The bobbin is a cylindrical member made of materials such as aluminum and resin, and a front end thereof is connected to diaphragm 101, and a rear end thereof is disposed in magnetic gap 151.

Voice coil body 106 is connected to a central portion of diaphragm 101, i.e., a relatively thin portion of diaphragm 101. Further, an upper portion of magnetic circuit 105 is surrounded by thick portion 113. As a result, a distance between magnetic circuit 105 and diaphragm 101 can be made small, and loudspeaker 100 can be thin.

Next, an operation of loudspeaker 100 in accordance with the above-mentioned exemplary embodiment will be described. When an electric signal is inputted to voice coil body 106, front support body 103 and rear support body 104 act as support bodies of diaphragm 101 without inhibiting the vibration of diaphragm 101 in forward/rearward direction. Front support body 103 includes front projection 131 and front depression 132, and rear support body 104 includes rear projection 141 and rear depression 142. Thereby, front support body 103 and rear support body 104 acoustically shield the sound emitted from the rear surface of diaphragm 101.

Further, the sum of an amount of air removed by front projections 131 and an amount of air removed by front depressions 132 at the time when diaphragm 101 is displaced frontward from a neutral position, and the sum of an amount of air removed by front projections 131 and an amount of air removed by front depressions 132 at the time when diaphragm 101 is displaced rearward from the neutral position are made equal. As for this, the case of rear support body 104 is also the same as the case of front support body 103. In other words, even when diaphragm 101 vibrates in forward/rearward direction, asymmetry of the removal amount of air is eliminated, thereby making it possible to prevent occurrence of distortion of sound.

As mentioned above, according to the present embodiment, diaphragm 101 is supported by front support body 103 including front projections 131 and front depressions 132, and rear support 104 plane symmetrical to front support 103. Front projections 131 and front depressions 132 are symmetrical to each other in the forward/rearward direction, and disposed rotation symmetrically. Thus, the amount of air removed by front support body 103 and the amount of air removed by rear support body 104 corresponding to back-and-forth amplitude of diaphragm 101 can be made equal, and the removal amount of air can be made constant, regardless of the vibration direction. Therefore, occurrence of distortion caused by asymmetry of the amount of air removed by the support body, which occurs conventionally, can be reduced drastically. Further, asymmetry of the force that supports diaphragm 101, which is caused by structural asymmetry, can be reduced. This makes it possible to provide loudspeaker 100 with extremely low distortion and good linearity.

Furthermore, thick portion 113 is provided in the rim portion of plate-shaped diaphragm 101 to secure structural strength of diaphragm 101. In addition, as the front part of magnetic circuit 105 is disposed inside annular thick portion 113, loudspeaker 100 can be thin. As a result, a thin loudspeaker with a high sound pressure level and small distortion can be provided.

Note that, the present disclosure is not limited to the above-mentioned exemplary embodiment. For instance, another exemplary embodiment realized by combining structural components described in the present description optionally or excluding some of the structural components may be construed as an exemplary embodiment of the present disclosure. Further, variants obtained by various modifications to the exemplary embodiments that can be conceived by a person of skill in the art, which are within the scope of the essence of the present disclosure, i.e., the meaning indicated by claim wording, may be included in the present disclosure.

For instance, in the above-mentioned exemplary embodiment, a loudspeaker is exemplified as an electroacoustic transducer, but the electroacoustic transducer may be a microphone or a sensor, which converts sound into an electric signal.

Figure 8:
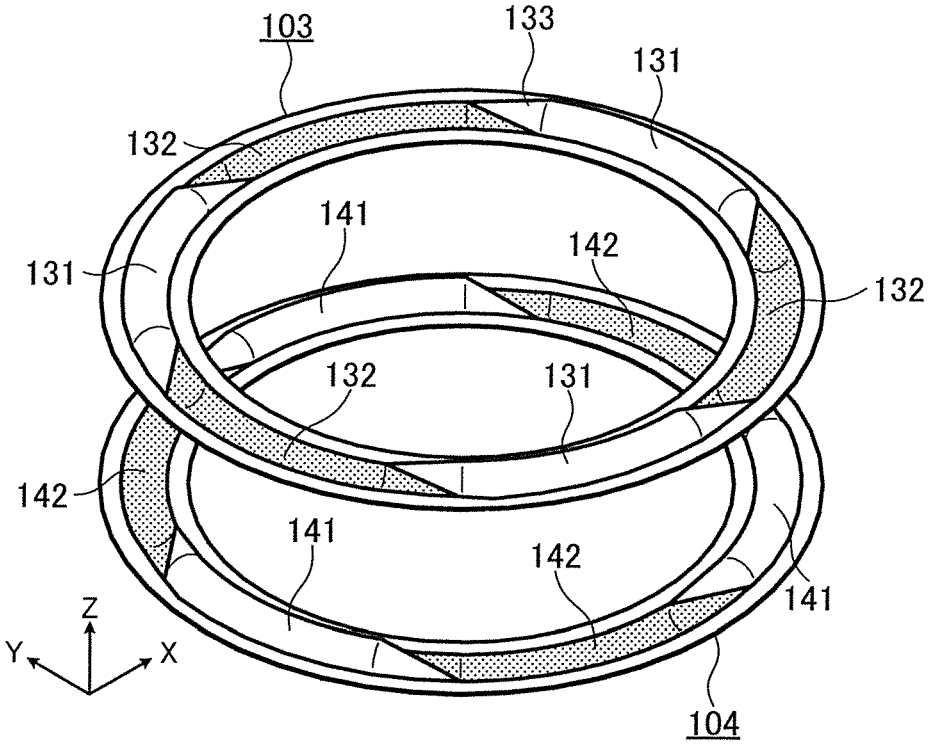
FIG. 8 is a perspective view showing another example of the front support body and the rear support body.

Further, in the above-mentioned exemplary embodiment, front support body 103 and rear support body 104 each including two projections and two depressions are exemplified, but the number of projections and depressions is not limited to this. As shown in FIG. 8, each of front support body 103 and rear support body 104 may include three or more projections and three or more depressions.

Still further, diaphragm 101, magnetic circuit 105, and voice coil body 106 are described to have a round shape in a plain view, but not limited to this. An elliptical shape or a rectangular shape in a plan view may be employed.

Furthermore, magnetic circuit 105 is not limited to an inner magnet type. An outer magnet type or a combination of an inner magnet type and an outer magnet type may be employed as magnetic circuit 105.

Still furthermore, any magnets such as a samarium iron based magnet and a ferrite based magnet can be employed as a magnet used for magnetic circuit 105.

The electroacoustic transducer in accordance with the present disclosure can achieve low distortion and slim down, and especially is applicable to audio equipment mounted to an automobile or the like, home audio equipment, and the like.

What is claimed is:

1. An electroacoustic transducer configured to convert an electric signal into sound, or sound into an electric signal, the electroacoustic transducer comprising:

a diaphragm including a central portion and a rim portion thicker than the central portion, the diaphragm having a front face toward a front and a rear face toward a rear;

a frame disposed to surround the rim portion of the diaphragm, and having a front annular portion corresponding to a front part of the rim portion and a rear annular portion corresponding to a rear part of the rim portion;

a front support body coupling the front part of the rim portion and the front annular portion of the frame together, and having a plurality of front projections projecting toward the front and a plurality of front depressions depressing toward the rear;

a rear support body coupling the rear part of the rim portion and the rear annular portion of the frame together, and having a plurality of rear projections projecting toward the front and a plurality of rear depressions depressing toward the rear;

a magnetic circuit provided with an annular magnetic gap facing the rear face of the diaphragm, and fixed to the frame;

a voice coil body having a rear end disposed in the magnetic gap and a front end coupled to the diaphragm;

two electrode terminals inserted through the frame from an inside of the frame toward an outside of the frame, and connected to the voice coil body, the two electrode terminals being disposed between a corresponding pair of a front projection and a rear depression that faces the front projection, the front projection being included in the plurality of front projections and the rear depression being included in the plurality of rear depressions, the two electrode terminals extending in directions opposite to each other; and two leads drawn out from the voice coil body in directions opposite to each other, wherein the front support body and the rear support body are disposed such that the plurality of front projections respectively face the plurality of rear depressions, and the plurality of front depressions respectively face the plurality of rear projections face, and wherein each of the two leads are formed along a shape of a space formed by the front projection and the rear depression, and are connected to one of the two electrode terminals disposed in the space.

2. An electroacoustic transducer configured to convert an electric signal into sound, or sound into an electric signal, the electroacoustic transducer comprising:

a diaphragm including a central portion and a rim portion thicker than the central portion, the diaphragm having a front face toward a front and a rear face toward a rear;

a frame disposed to surround the rim portion of the diaphragm, and having a front annular portion corresponding to a front part of the rim portion and a rear annular portion corresponding to a rear part of the rim portion;

a front support body coupling the front part of the rim portion and the front annular portion of the frame together, and having a plurality of front projections projecting toward the front and a plurality of front depressions depressing toward the rear;

a rear support body coupling the rear part of the rim portion and the rear annular portion of the frame together, and having a plurality of rear projections projecting toward the front and a plurality of rear depressions depressing toward the rear;

a magnetic circuit provided with an annular magnetic gap facing the rear face of the diaphragm, and fixed to the frame;

a voice coil body having a rear end disposed in the magnetic gap and a front end coupled to the diaphragm; and two electrode terminals inserted through the frame from an inside of the frame toward an outside of the frame, and connected to the voice coil body, the two electrode terminals being disposed between a corresponding pair of a front projection and a rear depression that faces the front projection, the front projection being included in the plurality of front projections and the rear depression being included in the plurality of rear depressions, and the two electrode terminals extending in directions opposite to each other, wherein the front support body and the rear support body are disposed plane symmetrically.

3. The electroacoustic transducer according to claim 2, further comprising two leads drawn out from the voice coil body in directions opposite to each other, each of the two leads being formed along a shape of a space formed by the front projection and the rear depression, and connected to one of the two electrode terminals disposed in the space.

4. An electroacoustic transducer configured to convert an electric signal into sound, or sound into an electric signal, the electroacoustic transducer comprising:

a diaphragm including a central portion and a rim portion thicker than the central portion, the diaphragm having a front face toward a front and a rear face toward a rear;

a frame disposed to surround the rim portion of the diaphragm, and having a front annular portion corresponding to a front part of the rim portion and a rear annular portion corresponding to a rear part of the rim portion;

a front support body coupling the front part of the rim portion and the front annular portion of the frame together, and having a plurality of front projections projecting toward the front and a plurality of front depressions depressing toward the rear;

a rear support body coupling the rear part of the rim portion and the rear annular portion of the frame together, and having a plurality of rear projections projecting toward the front and a plurality of rear depressions depressing toward the rear;

a magnetic circuit provided with an annular magnetic gap facing the rear face of the diaphragm, and fixed to the frame; and a voice coil body having a rear end disposed in the magnetic gap and a front end coupled to the diaphragm, wherein a total length of the plurality of front projections in a circumferential direction of the front support body is the same as a total length of the plurality of front depressions in the circumferential direction of the front support body.

* * * * *